United States Patent [19]

Young

[11] 4,055,390

[45] Oct. 25, 1977

[54] METHOD AND APPARATUS FOR PREPARING AGGLOMERATES SUITABLE FOR USE IN A BLAST FURNACE

[75] Inventor: William P. Young, LaGrange, Ill.

[73] Assignee: Molten Metal Engineering Co., Hinsdale, Ill.

[21] Appl. No.: 673,072

[22] Filed: Apr. 2, 1976

[51] Int. Cl.[2] ..... F27B 15/00; C22B 1/16

[52] U.S. Cl. ..... 432/14; 75/3; 432/105; 432/113

[58] Field of Search ..... 75/3, 5; 432/14, 105, 432/113, 118

[56] References Cited

U.S. PATENT DOCUMENTS

| | | | |
|---|---|---|---|
| 1,041,363 | 10/1912 | Souther | 75/5 |
| 1,216,667 | 2/1917 | Downs | 432/14 |
| 1,994,378 | 3/1935 | Williams et al. | 75/3 |
| 2,020,960 | 11/1935 | Pehrson et al. | 432/105 |
| 3,380,407 | 4/1968 | Nilsson | 432/118 |
| 3,652,260 | 3/1972 | Azami | 75/3 |
| 3,939,783 | 2/1976 | Chambon | 432/105 |

*Primary Examiner*—John J. Camby

[57] ABSTRACT

Processes for preparing agglomerates containing iron oxide and suitable for charging as a feed material into a blast furnace and apparatus for effectively carrying out these processes. Waste matter from commercial iron and steel operations containing iron oxide and combustible matter is charged as feed into a rotating cylinder where it is ignited by flame from a jet; then an oxygen containing gas is passed under pressure through a wind box upwardly through passages through the walls of the cylinder and upwardly through particles of burning, tumbling particles of feed matter as this matter moves as a stream and comes into agglomerate form. The treated material is discharged in agglomerate form at the end of the rotating cylinder. These agglomerates may be effectively utilized as iron bearing feed material by charging them along with other charge materials into a blast furnace.

8 Claims, 2 Drawing Figures

METHOD AND APPARATUS FOR PREPARING AGGLOMERATES SUITABLE FOR USE IN A BLAST FURNACE

This invention relates to a process for preparing iron containing agglomerates suitable for charging into a blast furnace, and relates also to apparatus which is particularly effective for carriying out such a process.

BACKGROUND

Commercial operations in the production and treatment of iron and steel are known to result in substantial quantities of waste materials which contain iron oxide. These include fines from screened ores, mill scale, blast furnace flue dust, thickener mud and dust from steel mill dust collectors.

Blast furnace charge materials may be screened immediately before charging to eliminate fine particles from the charge. These fines which come from the screening operation contain iron oxides just as do the larger particles used in the furnace charge, but they are too fine to be effectively used as furnace charge materials. Blast furnace flue dust contains fine particles of coke, iron oxides, calcium carbonate and any volatile hydrocarbons that may condense in the gas cleaning system of the furnace. Mill scale is formed during the rolling or working of steel and contains iron oxides along with volatile materials such as grease and oil. Dust from dust collectors on steel melting furnaces includes lime, silica, iron oxide and manganese oxide. These particles are very fine and are usually carried by the air currents to the dust collector. When treated with water the insoluble particles are settled out to form a mud which is usually recovered by use of a filtering process. This mud includes fine particles of coke, iron oxide, oils and grease.

The fine materials above described are waste materials in that they cannot be effectively utilized in the usual commercial processes employed in the production and treatment of iron and steel. Further, the disposition of these waste materials is a problem to the industry because when allowed to accumulate, these materials come into great volume. However, they do contain from 30 to 80 weight percent of iron oxide and usually from 2 to 15 weight percent of combustible materials such as coke, oil or grease. Dust from steel making furnaces may have relatively small amounts of combustibles, such as from 0 to 3 percent, but flue dust from blast furnaces may have relatively large amounts of combustibles, such as from 10 to 60 percent. Such materials may be blended to form a mixture that has the desired amount of fuel. They may also contain small quantities of calcium oxide, magnesium oxide, and aluminum oxide. It would be very desirable if a way could be found to efficiently process these materials to make them acceptable as charging materials in a blast furnace. Accordingly, I have sought to find processes and apparatus which will accomplish this purpose, and I have discovered the improved process and apparatus which will now be set forth.

DESCRIPTION

One embodiment of apparatus for carrying out my invention is shown in the accompanying drawings in which.

As illustrated, the apparatus includes a cylinder A which is arranged for rotation about its longitudinal axis and which is positioned so that its longitudinal axis slants downwardly from the upper or feed end to the lower or discharge end of the cylinder. The upper end is open so that the waste material can, as fine particles, be introduced into the feed end of the cylinder. Likewise, the lower end of the cylinder A is open so that after the material 10 has been formed into agglomerates it may be discharged from the cylinder.

At the upper end of cylinder A, I provide a nozzle 11 which is arranged to direct flammable gas into the upper portion 14 of the cylinder so that when the gas is ignited the flame 11*a* is produced which contacts the feed material and so it ignites the combustible matter contained in it.

Figure 2:
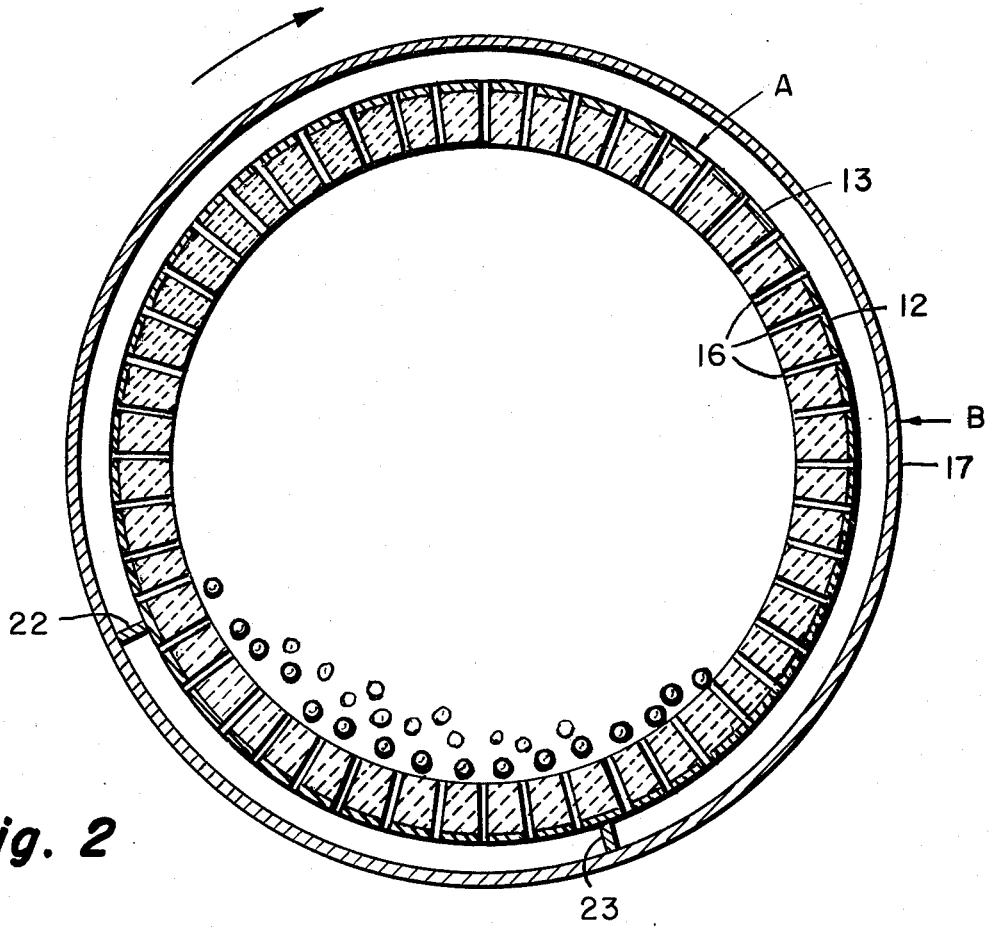
FIG. 2 is a transverse sectional view taken as seen from line 2—2 of FIG. 1.

The cylinder A has an outer metallic shell 12 and inside this shell is the refractory material 13. The shell and its refractory lining 13 rotate and as the feed material 10 in particulate form is introduced into the upper end of the cylinder and is ignited by the flame it forms a bed at the bottom side of this cylinder in which the particles are constantly burning and are in a tumbling motion. This is shown more clearly in FIG. 2 where the particles of material 10 are in a flowing stream moving toward the discharge end of the cylinder and being constnatly tumbled due to the rotation of the cylinder.

Figure 1:
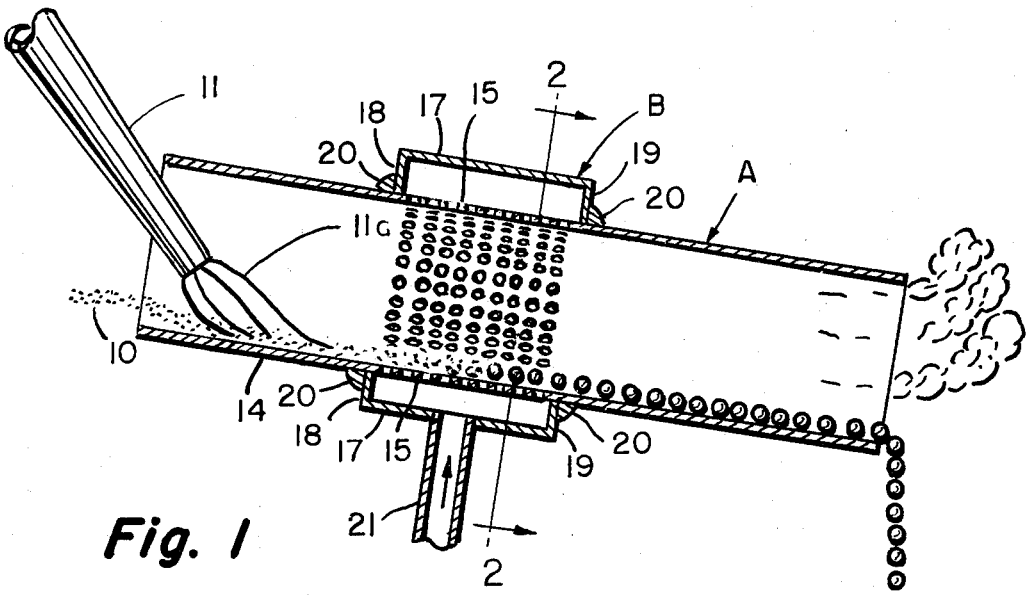
FIG. 1 is an elevational view in section of the improved apparatus.

Referring now to FIG. 1, the wall of the cylinder A is in this figure shown as being perforated at an annular area 15 downstream of the flame. The showing of the perforated wall is done schematically in FIG. 1, and in more detail in FIG. 2 where we see the tubes 16. These tubes are in spaced relationship in the area 15. They communicate at their outer ends with the perforations in the shell 12 and their interiors provide passages leading from the perforations in shell 12 through the refractory material 13 to the interior of the cylinder A.

Extending about the cylinder A at area 15 is what I call a wind box B. This includes a cylindrical wall 17 which is coaxial with and radially spaced from the cylinder A. End pieces 18 and 19 extend inwardly from the ends of they cylindrical piece 17 almost to the shell 12 of the cylinder A, and resilient material 20 is provided to close the small gap between ends 18, 19 and shell 12.

The pipe 21 and the wind box B provide conduit means through which air or other oxygen containing gas is passed through area 15, and from here the gas is passed through the tubes 16 to the interior of the cylinder A, and then upwardly through the stream of burning tumbling particles of material 10.

The gas being passed through the conduit means to area 15 is further guided and caused to enter the tubes 16 below the material 10 by the provision of baffles 22 and 23 which extend lengthwise of the wind box and substantially block the space between the cylindrical piece 17 and the shell 12 of the cylinder A so as to confine the gas primarily to the area 15 of the cylinder which is below the stream of material 10.

OPERATION

Using the apparatus illustrated in the drawing and described herein the feed material may be fines from screened ores, mill scale, blast furnace flue dust, thickener mud, or dust from steel mill collectors, or mixtures of any of these. The material contains from 30 to 60 percent iron oxide and from 5 to 15 weight percent of combustible materials such as coke, oil and grease, and may contain also small amounts of calcium oxide, magnesium oxide and aluminum oxide. These metal oxides need not be removed as they serve very well as binders for the agglomerates being formed. Should the waste material to be treated contain less volatile or combustible material than above referred to or not enough such material to supply the heat needed for agglomeration, quantities of coke may be added to the material to bring its content of combustible matter within the range specified. I find that a carbon content of about 5 to 9 percent of carbon (based on the weight of the charge) is required.

The size of the particles in the feed material may be of a size such that substantially all of them will pass a ⅜ inch mesh screen.

The feed material is introduced into the upper end of the rotating cylinder A where it immediately forms a tumbling stream which travels at the bottom part of the cylinder toward the discharge end. The cylinder A is caused to rotate at a speed which may suitably be of the order of from ½ revolution per minute to 2 revolutions per minute.

Soon after the material enters the cylinder A it comes into contact with the flame from nozzle 11, and the combustible material is ignited. As the material passes on through the length of the cylinder A it comes over the area 15 at the bottom part of the cylinder. Here air at a pressure of from 1 to 5 p.s.i. is passed into the wind box B and passes upwardly guided by baffles 22 and 23 through the tubes 16 and upwardly through the tumbling particles of burning material. The products of combustion ad resulting gasses may pass through the cylinder A and be discharged at the end of the cylinder.

The ignitor flame brings the temperature of the material up to a temperature of about 1500° to 1800° F as it enters the wind box zone, and the burning of the combustibles in the wind box zone raises the temperature of the material to between about 2200° F and 2600° F. The continued burning of the combustibles produces sufficient heat to fuse the particles in the form of agglomerates, which due to the rotation of the cylinder are round or near round. These agglomerates roll out of the discharge end of the cylinder A.

It is an advantage of the process and apparatus herein set forth that the draft of air or the oxygen bearing gas is upwardly through the bed of tumbling, burning particles rather than downwardly through this bed, since CO is one of the gasses being generated and in other processes which may resemble sintering where CO is permitted to move downwardly there is always a hazard that through leakage of CO an explosion may result. In the improved process and apparatus herein set forth, such hazard is avoided.

Typically, the agglomerates may have an analysis such as given below:

EXAMPLE I

| Acid Agglomerates | |
|---|---|
| 70 to 80% | iron oxide |
| 2 to 6% | calcium oxide |
| 1 to 3% | magnesium oxide |
| 1 to 5% | aluminum oxide |

EXAMPLE II

| Self-Fluxing Agglomerates | |
|---|---|
| 60 to 70% | iron oxide |
| 5 to 10% | calcium oxide |
| 3 to 6% | magnesium oxide |

EXAMPLE II-continued

| Self-Fluxing Agglomerates | |
|---|---|
| 5 to 10% | silica |
| 1 to 5% | aluminum oxide |

EXAMPLE III

| Basic Agglomerates | |
|---|---|
| 55 to 70% | iron oxide |
| 7 to 13% | calcium oxide |
| 4 to 7% | magnesium oxide |
| 5 to 10% | silica |
| 1 to 5% | aluminum oxide |

Basis agglomerates may conveniently be produced by adding limestone or dolemite to the charge, and then adjusting the coke content of the charge in accordance with the added limestone or dolemite.

The resulting agglomerates may then be charged into a blast furnace to supply at least a part of the iron oxides to be charged into the furnace. The agglomerate form permits good distribution over the area of the furnace, and at the same time, provides spaces between the agglomerate particles which yields better passage for the air which passes between them. The agglomerates have good strength and are not easily abraided or crushed.

While I have illustrated and described in detail only certain embodiments of the invention it will be apparent to those skilled in the art that many other embodiments may be utilized and many changes may be made all within the spirit of the invention and the scope of the following claims.

I claim:

1. A method for preparing agglomerates suitable for charging into a blast furnace comprising rotating a cylinder having open ends about its longitudinal axis while said axis is inclined with the horizontal, charging into the upper open end of said cylinder while said cylinder is rotating a stream of iron oxide bearing material containing 5 to 15 weight percent of combustible material, said material being in particulate form and of a size such that substantially all of said iron oxide bearing material will pass a ⅜ inch screen, whereby said iron oxide bearing material is caused to move downwardly in said cylinder in a tumbling stream toward the lower end of said cylinder, subjecting said charged material at the upper end portion of said cylinder to contact with a flame whereby to ignite said material in said portion, passing an oxygen containing gas in a confined stream to an area below said stream of material as the material passes downwardly in said cylinder, passing said gas from said area through the wall of said cylinder and upwardly through said stream to support combustion of materials in said stream and heat said material to from 2200° F to 2600° F and discharging from the lower end of said cylinder agglomerates formed of said material during its passage through the said cylinder.

2. A method as set forth in claim 1 wherein said charged material contains from about 30 to 80 percent iron oxide.

3. A method as set forth in claim 1 in which said charged material is blast furnace flue dust, thickener mud, mill scale, fine screened ores, or a mixture thereof together with the combustible material.

4. A method as set forth in claim 1 including the step of introducing said agglomerates into a blast furnace to provide at least a part of the iron bearing material fed to said furnace.

5. A rotary kiln for the preparation of agglomerates suitable as a feed material for a blast furnace comprising a cylinder having its upper end open for the feeding of materials into said cylinder and having its lower end open for the discharge of agglomerates therefrom, said cylinder being rotatable about an inclined longitudinal axis, means for producing at an upper portion of said cylinder a flame in a position to contact combustible material so fed into said cylinder at its upper end so as to ignite the same, said cylinder being lined with refractory material and having an annular area between said flame producing means and said lower end at which area said cylinder contains radially spaced passages through said cylinder and refractory material, a cylindrical wall concentric with and spaced from said cylinder, and end pieces extending radially from said cylindrical wall toward said cylinder, said cylindrical wall and end pieces forming an enclosure which embraces said area, conduit means for passing oxygen-containing gas into said enclosure and through said passages into the interior of said cylinder for supporting combustion of said combustible materials therein.

6. A rotary kiln as set forth in claim 5 including baffle means extending between said cylindrical wall and said cylinder for confining gas passed through said conduit means primarily to an area of said cylinder which is beneath said stream.

7. A rotary kiln as set forth in claim 5 including baffle means extending radially between said cylinder and said wall and longitudinally of said cylinder for confining said gas primarily to said area under said stream.

8. A rotary kiln as set forth in claim 7 including spaced tubes extending radially through said refractory material and aligned with said perforations to thereby bring said annular enclosure into communication through said tubes with the interior of said cylinder.

* * * * *